United States Patent [19]

Wolf

[11] Patent Number: 4,694,643

[45] Date of Patent: Sep. 22, 1987

[54] SPINNING OR TWISTING MACHINE

[75] Inventor: Horst Wolf, Albershausen, Fed. Rep. of Germany

[73] Assignee: Zinser Textilmaschinen GmbH, Ebersbach, Fed. Rep. of Germany

[21] Appl. No.: 819,541

[22] Filed: Jan. 16, 1986

[30] Foreign Application Priority Data

Jan. 18, 1985 [DE] Fed. Rep. of Germany ..... 3901530

[51] Int. Cl.[4] ..... D01H 1/20; D01H 1/24; D01H 1/241; D01H 1/28

[52] U.S. Cl. ..... 57/100; 57/78; 57/81; 57/92; 57/93

[58] Field of Search ..... 57/261–264, 57/266, 276, 78–80, 81–83, 92–100

[56] References Cited

U.S. PATENT DOCUMENTS

| | | | |
|---|---|---|---|
| 2,349,882 | 5/1944 | Reichelt | 57/100 |
| 3,536,699 | 11/1970 | Cunningham | 57/93 X |
| 3,738,095 | 6/1973 | Lohest | 57/93 X |
| 3,780,513 | 12/1973 | Watanabe et al. | 57/93 |
| 3,791,128 | 2/1974 | Landwehrkamp et al. | 57/93 X |
| 3,939,638 | 2/1976 | Bruckert et al. | 57/93 X |
| 3,986,330 | 10/1976 | Kuttuff et al. | 57/264 X |
| 4,163,359 | 8/1979 | Honjo | 57/93 |

*Primary Examiner*—Donald Watkins
*Attorney, Agent, or Firm*—Karl F. Ross; Herbert Dubno

[57] ABSTRACT

For compensation of changes in rotational speeds, for example, occurring because of varying loads on the motors, the drive mechanisms for at least two kinds of working units have a common synchronizing mechanism and are connected operably by a torque transfer device. The torque transfer device comprises, for example, a drive belt and two drive pulleys, each of which is attached to a different drive mechanism. The common synchronizing mechanism can comprise either a common rotational speed control or an adjustable current supply for the motors of the drive mechanisms.

16 Claims, 5 Drawing Figures

SPINNING OR TWISTING MACHINE

FIELD OF THE INVENTION

My present invention relates to a spinning or twisting machine and, more particularly, to spinning machines, twisting machines, and the like, which have compensating mechanisms to prevent fiber or yarn breaking as a result of a shut off of one or more prime movers due for example to power failure.

BACKGROUND OF THE INVENTION

Machines for spinning or twisting yarn generally comprise at least two kinds of working units, each of which is associated with a drive mechanism having at least one prime mover or motor, preferably an electric motor, so that on interruption of the energy supply the rotational speed of each of the drive mechanisms drops alone or together with the rotational speed of the remaining ones of the drive mechanisms from an operational value of the rotational speed.

The machines with which the invention is concerned can be ring spinning frames, ring twisting frames, open-end-rotor spinning frames, open-end friction spinning frames, or the like.

The common feature of all these machines is that they produce spun or twisted thread, fiber, yarn, or the like generally referred to as yarn herein. For the purposes of this application, moreover, a twisted yarn is considered to be a variant of a spun fiber yarn.

As the starting material for the spun or twisted yarn, for example, spun fibers, endless fibers, or filaments can be used.

The working units can be, for example, spindles, rotors, yarn-releasing or disentangling rollers, drafting rollers or frames, or the like.

The torque or force transfer from the electric motor and/or drive mechanism to the working unit is effected for example by shafts, tangential belts, or the like.

Various kinds of working units, each operated by its individual drive mechanism during normal operations, have suitable inputs to the corresponding motors to provide at least approximately constant rotational speed ratio between the units.

However during an abnormal operation, when either one motor is cut off from the power supply or the power supply fails to one or more motors, the approximately constant rotational speed ratio or relationship is no longer guaranteed, since then the working unit driven by the motor cut off from the power supply comes to a standstill.

Furthermore the drive mechanisms with the various working units have different speed fall off or run down characteristics and different run down times from the normal rotational operational speeds to standstill.

As a result, during such run down faults can occur in the product, for example, due to overspinning of the yarn. In some cases these faults are accompanied by more serious events, for example yarn breaking.

In abnormal operating conditions, for example, power failure, anomalous operating conditions occur immediately which lead to machine stoppages and product damage.

OBJECTS OF THE INVENTION

It is the principal object of my invention to provide an improved machine for spinning or twisting fiber, thread, yarn, or the like whereby the aforementioned drawbacks are obviated.

It is also an object of my invention to provide an improved spinning or twisting frame, in which a loss of quality in the product of the spinning operation during anomalous operation is prevented.

It is a further object of my invention to provide an improved spinning or twisting machine wherein constant rotational speed relationships of the drive mechanisms therein are maintained even during anomalous operation, as well as during normal operation, in order to minimize fiber breaking and to provide a better quality spun or twisted product.

SUMMARY OF THE INVENTION

These objects and others, which will become more apparent hereinafter, are attained in accordance with my invention in a machine for spinning or twisting yarn with at least two distinct working units, each of which is connected with a drive mechanism having at least one motor individual to that unit and wherein the two units are normally driven at coordinated speeds, wherein on interruption of the energy supply to one or all motors the rotational speed of each of the drive mechanisms runs down together with but at a rate different from the rotational speed of the remaining of the drive mechanism from a normal operational value of the respective rotational speed.

According to my invention the drive mechanisms have a common speed coordinating or synchronizing mechanism or means, and are further connected operationally with each other by at least one torque transfer device effecting torque transfer from at least the mechanism whose motor remains active or has the slower run down rate to the other mechanism.

My invention guarantees a synchronization of the drive mechanisms even during anomalous operation, for example, such as a failure of the energy supply, shut off, or starting up of the machine, or variable or oscillatory loads on the motors.

My invention also allows the use of inexpensive asynchronous electric motors as the motors of the respective drive mechanisms.

The torque transfer device must receive no excessive loads. It needs to transfer as large a torque as is required to balance variations in rotational speed occurring due to varying loads on the motors.

According to a preferred embodiment of my invention at least one, and preferably each, of the torque transfer devices has a means for limiting torque. One such means could, for example, comprise a torque limiter, e.g. a slip coupling between two members in a drive chain.

When according to another feature of my invention a linkage means provides a frictional linkage between two of the drive mechanisms on one of the torque transfer devices, then this linkage means also limits the torque. This is for example the case, when the torque transfer device has drawing means causing a frictional connection, for example a drive belt. With a suitable adjustment of the belt tension such a drive belt can slip, when a predetermined value of torque is exceeded, relative to its pulley.

In a definite operating state of the machine, for example, in starting or stopping, it can be necessary or advantageous to delay the operation of at least one operating element of the machine or to decouple the latter. Hence it is another feature of my invention to provide a switchable coupling means between the torque transfer device and one of the drive mechanisms in the working connection to that operating element.

By the delayed activation of the coupling and necessarily of the associated motor the one drive mechanism may be activated later than the others. In stopping of the machine after disconnecting the coupling, both drive mechanisms run independently of each other.

So that in all cases an excessive large torque will not be transmitted by the torque transfer device to cause machine damage, the torque transfer device has an overload safety means, e.g. a simple shear pin.

According to a further feature of my invention the common synchronizing mechanism comprises a common rotational speed control for the motors of the drive mechanism. By this kind of common rotational speed control the synchronization of the drive mechanism can be simplified.

According to another preferred embodiment of my invention the common synchronizing device comprises an adjustable common current supply for all of the motors, when all of the motors are electric motors. By changing the frequency of the current supplied to the individual electric motors the adjustable current supply device controls the rotational speed of the motors. However there are other possibilities for control of the current flow to or the rotational speed of the motors according to the invention. The common synchronizing device, for example, can also control the rotational speed by changing the voltage or current flow.

In another feature of this preferred embodiment the torque transfer device comprises a first and second coupling means and a variable speed ratio gear unit or transmission, wherein the first coupling means is positioned between the gear unit or transmission and the drive mechanism requiring a longer time for run down or shut down, and the second coupling means is positioned between the variable speed ratio gear unit and the drive mechanism requiring a shorter time for the run down or shut off. Thus for example in a ring spinning machine the drafting frame running rollers can be driven after shut off for fixed time intervals, while the spindles run down.

In another feature of this embodiment the first coupling means positioned between the variable speed ratio gear unit and the drive mechanism requiring a longer time for run down or shut down comprises a switchable coupling, which is activated during power failure, and the second coupling means positioned between the variable speed ratio gear unit and the drive mechanism requiring a shorter time for the run down or shut down comprises a freely running member preventing a transfer of torque from the drive mechanism to the variable speed ratio gear unit, while allowing the transfer of the torque in the opposite direction.

In normal operation the variable speed ratio gear unit is idle i.e. the input and output shafts can rotate at the same speeds with the mechanism (e.g. the planetary gearing) preventing torque transmission between them.

The transmission is activated on the drive mechanism requiring a longer time for run down or shut down on occurrence of an anomalous operating condition, for example a power failure. After the variable speed ratio gear unit runs, it transfers a toruqe to the other remaining drive mechanisms, to which this drive mechanism is connected, to maintain the rotational speed ratio set by the variable speed ratio gear unit. At this point the free running member activates the rotational moment transfer from the variable speed ratio unit to the attached drive mechanisms. The rotational spped ratio of the drive mechanisms then remain constant and the feared interruptions or disturbances of operation can not occur.

BRIEF DESCRIPTION OF THE DRAWING

The above and other objects, features, and advantages of my invention will become more readily apparent from the following description, reference being made to the accompanying highly diagrammatic drawing in which.

SPECIFIC DESCRIPTION

Figure 2:
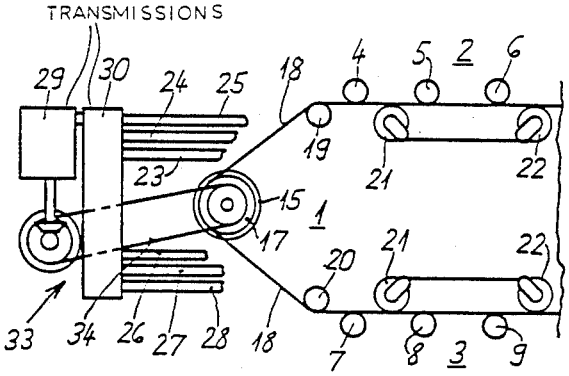
FIG. 2 is a schematic partial plan view of a preferred embodiment of the ring spinning machine of FIG. 1 according to my invention.
Figure 1:
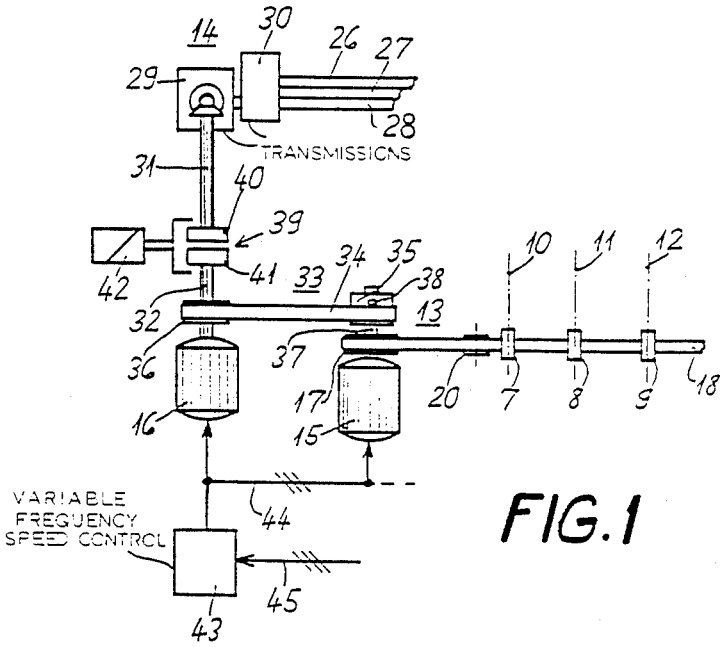
FIG. 1 is a schematic elevational view of a ring spinning machine.

A first preferred embodiment of a ring spinning machine 1 has a first side 2 and a second side 3 shown in FIG. 2. Whorls 4, 5, and 6 are shown on the first side 2 of the ring spinning machine 1 and whorls 7, 8, and 9 are shown on the second side 3 of the ring spinning machine 1 in FIG. 2. In FIG. 1 only the whorls 7, 8, and 9 are visible, which belong to spindles 10, 11, and 12. The spindles 10, 11, and 12 are only indicated by their centerlines or axes of rotation.

The spindles positioned on both sides of the machine represent a first kind of working unit, which has a drive mechanism 13 individual to it. The drive mechanism 13 contains a source of motive power or prime mover in the form of an electric motor 15, a drive pulley 17, and a tangential belt 18 endlessly circulating around the drive pulley 17. Guide rollers 19 and 20 guide the tangential belt 18. Press rollers 21 and 22 provide for a good mounting of the tangential belt 18 on the whorls 4 to 9.

Another kind of working unit comprises the rolling mill rollers 23 to 28, which are divided into groups of three on both sides 2 and 3 of the ring spinning machine 1. The rolling mill rollers 23–28 have a single drive mechanism 14, comprising two gear units 29 and 30 connected with each other, wherein the gear unit 29 is connected by a working connection 31 with an electric motor 16. The working connection 31 comprises a rotatably mounted shaft. An electric motor shaft 32 also forms a single shaft unit with the working connection 31.

The drive mechanisms 13 and 14 are connected operably by a torque transfer device 33 effective in both directions. The torque transfer device 33 has a linkage means working between the drive mechanisms 13 and 14, and at the same time means limiting the torque, comprising a tension medium in the form of a drive belt 34, a drive pulley 35, and a drive pulley 36. The drive pulley 35 is mounted by a shear pin 38 on the shaft 31 of the electric motor 15 and operates as a connecting coupling between the drive mechanism 13 and the torque transfer device 33. The shear pin 38 serves here as an overload safety means. Instead of the shear pin 38 the drive pulley 35 can have a special torque limiting device or can be constructed as a torque moment limiter itself by permitting slip between one of the pulleys and the belt. The other drive pulley 36 is connected with the shaft 32 of the electric motor 16, which finds itself operating as a single unit with the working connection 31.

In this working connection 31 a switchable coupler 39 is mounted between the drive mechanism 14 and the torque transfer device 33. The switchable coupler 39 comprises two coupling members 40 and 41 and an electromagnetic drive 42 which connects the coupling members 40 and 41. The coupling member 40 sits on the shaft 31 and the coupling member 41 sits on the shaft 32.

Both electric motors 15 and 16 have a common synchronizing mechanism in the form of a rotational speed control 43. For these electric motors 15 and 16, simple and inexpensive three phase current asynchronous motors, which are supplied with three phase current by a conductor 44 from the rotational speed control 43, can be used. The power supply is effected by conductor 45, which is connected to the rotational speed control 43. The rotational speed control 43 can be used to change the frequency of the three phase current flow, and therefore to control the frequency of the three phase current flow and the rotational speeds of the connected electric motors 15 and 16.

The spindles 4 to 9 have a large mass (inertia) and low frictional resistance to rotation, while the drafting frame rollers 24 to 28 in contrast have a smaller mass (inertia) but a high frictional resistance to rotation. On simultaneously switching on of both electric motors 15 and 16 the rolling mill drive motor 16, designed for overcoming the frictional resistance to rotation of the drafting frame rollers, accelerates the drafting frame rollers faster than are the spindles associated with the spindle drive motor 15. Therefore the motor 16 transfers through the torque transfer device 33 a torque to the drive mechanism 13 of the spindles. Thus the acceleration of the drafting frame is coupled mechanically with the acceleration of the drive mechanism 13, so that the provided rotational speed ratio between the drive mechanisms 13 and 14 and thus between the spindles and the rolling mill rollers is maintained.

On switching off both motors 15 and 16 a torque is transferred reciprocally through the torque transfer device 33 from the drive mechanism 13 to the drive mechanism 14.

Particularly with worsted yarn ring spinning machines to draw or pull out curls and kinks in the thread or fiber the spindles should start sooner than the drafting frame rollers. For this purpose on starting the ring spinning machine before switching on the electric motors 15 and 16 the clutch 39 is released, and after a short time, for example after a few seconds, is closed or engaged.

In case a mistake in the switching or in the operation occurs and the drafting frame drive motor 16 is switched on this motor with the drive could overload the entire machine. In this case the connected torque transfer mechanism 33 slips or the shear pin 38 shears and thus prevents injury to the drive motor 16.

In order to allow a change in the sense of rotation of the spindles 4 to 9 with a change over from S-twist to Z-twist or reversal of the rotation direction of the unchanged drafting frame rollers 24 to 28, a reversing gear in the torque transfer device 33 can be switched on.

Figure 5:
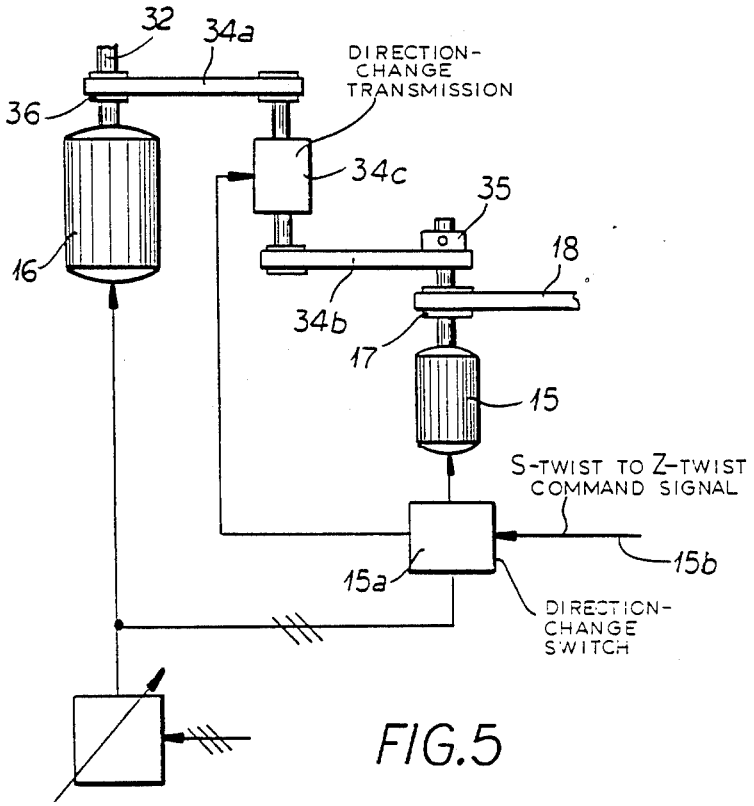
FIG. 5 shows a modification by the system of FIGS. 1 and 2.

More specifically, as seen in FIG. 5, a reversing gear **34*c* can be mounted between belt segments 34*a* and 34*b* coupling the motor 16 with the motor 15. This direction change transmission is switched over when the direction-change or reversal switch 15*a* for the motor 15 is operated by the command signal 15*b*** to shift from S-twist to Z-twist and vice versa.

Figure 3:
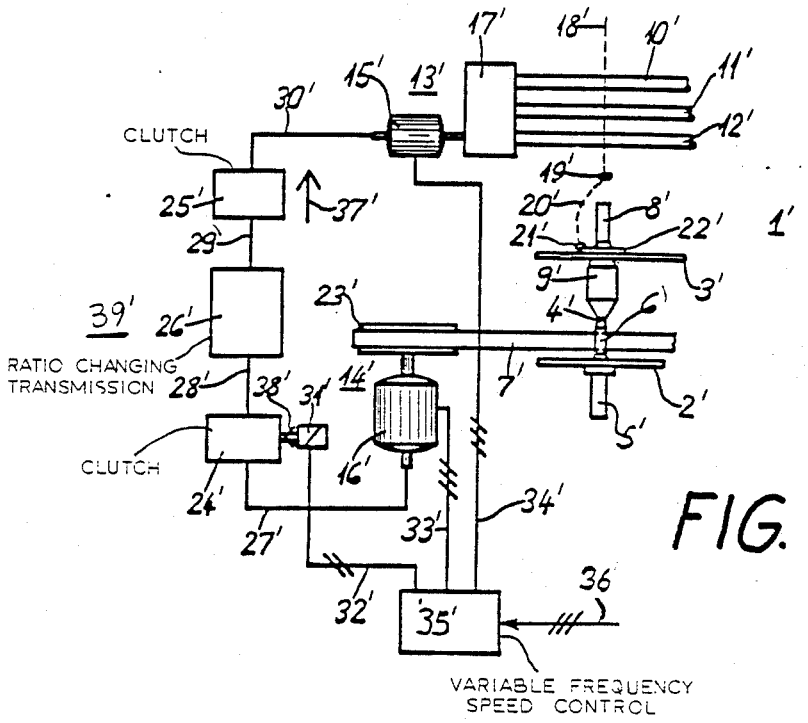
FIG. 3 is a schematic top view of a second embodiment of a ring spinning machine according to my invention.

In the second embodiment according to FIG. 3 the ring spinning machine 1' has a spindle bank 2' and a ring bank 3' moving up and down. A first kind of working unit comprises a plurality of spindles, of which only the spindle support 4' is shown. The spindle 4' is mounted in a spindle support 5', which is attached to the spindle bank 2'. The spindle 4' supports a whorl 6', which contacts a tangential belt 7'. The sleeve or core 8' and its bobbin 9' are mounted on the spindle 4' in the usual manner.

An additional kind of working unit comprises a plurality of rolling mill rollers 10', 11' and 12', which have a drive mechanism indicated with 13'. The drive mechanism 13' comprises an electric motor 15' and a gear unit 17'. A yarn 18' coming from above is drafted by the help of the drafting frame rollers 10', 11' and 12', runs through a yarn-guide eye 19', and as a twisted fiber 20' passes through a traveler ring 21' from the spool 9'. The traveler ring 21' orbits on a ring 22', which is mounted on the ring bank 3'.

The previously mentioned tangential belt 7' belongs to an additional drive mechanism 14', which has a drive pulley 23' and an electric motor 16'.

The drive mechanisms 13' and 14' are connected with each other by a torque transfer device 39', which has first and second coupling means 24' and 25' and a mechanical variable speed ratio gear unit 26'. The shafts 27' to 30' operate as operating connectors. The shaft 27' is connected with the shaft of the electric motor 16', while the shaft 30' is connected with the shaft 30' of the electric motor 15'.

The first coupling means 24' or clutch positioned between th variable speed ratio gear unit 26' and the drive mechanism 14' requiring a longer time for run down is switchable and will be active when there is a power shut off. The first switchable coupling 24' has an electromagnetic drive 31', which is connected by a conductor 32' with a current supply device 35'. Additional conductors 33' and 34' lead from the current supply device 35' to the electric motors 16' and/or 15'. The current supply device 35' is provided with current through the conductor 36'.

As long as the electromagnetic drive 31' is provided with current, it holds the first coupling 24' open or released. In a power failure the first coupling 24' is automatically operated, since the coupling members held away from each other electromagnetically are now pressed to each other by the compressive force of a spring.

The coupling means 25' positioned between the variable speed ratio gear unit 26' and the drive mechanism 13' requiring a shorter time for run down or shut down comprises a freely running member 25' preventing the transfer of torque from the drive mechanism 13', but allowing a torque transfer in the opposite direction. The second coupling means or freely running member 25' is for example a free running, unidirectional or override clutch.

In normal operation the variable speed ratio gear unit 26' is idle. After a power failure the kinetic energy of the drive mechanism 14' is still proportionally larger.

Besides a fixed energy feedback occurs through the whorls 6'. The kinetic energy of the other drive mechanism 13' is proportionally smaller in contrast to it and the gear unit 17' acts as an additional brake.

Before the speed ratio existing between the drive mechanisms 13' and 14' can change appreciably, the switchable coupling 24' automatically couples the shafts 27' and 28', whereby the variable speed ratio gear unit 26' is shifted into rotation.

As soon as the drive shaft 29' of the variable speed ratio gear unit 26' reaches the rotational speed of the shaft 30', the second coupling means or freely running member 25' automatically activates the torque transfer in the direction of the arrow 37'. From this point in time drive mechanism 13' is driven increasingly by the shaft 30', and the rotational speed ratio preset by the variable speed ratio gear unit 26' between the shaft 27' and 30' remains constant.

The power failure happens for example by a voltage drop, and the voltage can subsequently be turned on; a delay mechanism 38' holds the first coupling means 24' in an uncoupled condition, after it has been set in to the uncoupled condition. For example in this embodiment the delay mechanism 38' is provided between the electromagnetic drive 31' and the first switchable coupling means 24'.

The rotational speed ratio between the drive mechanisms 13' and 14' is variably adjustable according to the number of rotations for each meter of, for example, by a variation in the power supplied to the electric motors 15' and 16' from the current supply device 35'. In order to maintain this rotational speed ratio also in a power failure, the gear ratio of the variable speed ratio gear unit 26' also must be correspondingly changed. It has been shown however, that it is enough, when the gear ratio of this variable speed ratio gear unit 26' is adjusted to a value which is larger than the commonly selected speed ratio between the drive mechanisms 13' and 14', however smaller than the value, at which the previously covered disadvantages and mistakes occur. For example the rotational speed ratio between the drive mechanisms 13' and 14' has been between 1/1.25 to 1/1.60 (diverging fiber rotation or greatly increased fiber breaking occurs, when the rotational speed ratio is greater than 1/1.80). The gear ratio of the variable speed ratio gear unit 26' can advantageously be adjusted to, for example, 1/1.70. Thus all existing speed ratios between the drive mechanisms 13' and 14' are adjusted. Without such adjustment the gear ratio of the variable speed ratio gear unit 26' must be corrected, and, nevertheless though in an uncontrolled shut off of the machine adjustment of the speed ratio is prevented, which leads to fiber or thread breaking or unacceptable faults.

Figure 4:
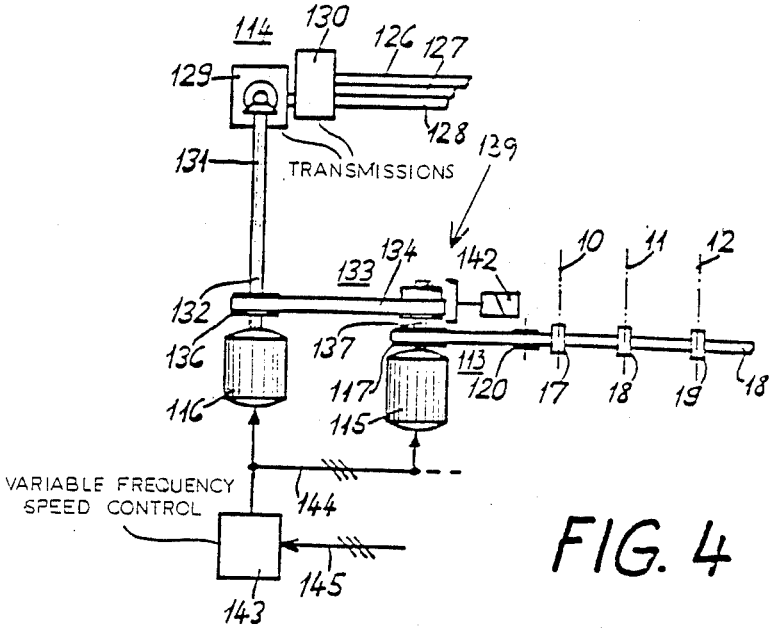
FIG. 4 is a schematic view of a third embodiment of a ring spinning machine according to my invention similar to the first preferred embodiment.

A variant of my invention is shown in FIG. 4 an differs from the embodiment shown in FIGS. 1 and 2 as follows:

Instead of in the working connection 131 a switchable coupler 139 is found in the drive shaft 137 between the drive mechanism 113 and the torque transfer mechanism 133. The coupler 139 is closed either only in a power failure or on starting or stopping of the machine, or it is closed in another type of operation during spinning and only released during looping. It is operable by an electromagnetic drive 142.

Other parts of this embodiment the same or similar to parts of the embodiment of FIGS. 1 to 2 are labelled with a reference number which is equal to the reference number used for the identical or similar part in the embodiment of FIGS. 1 and 2 plus 100. In contrast primed reference numbers are used for the embodiment shown in FIG. 3.

I claim:

1. In a machine for spinning or twisting yarn with at least two kinds of working units, each of which is connected with a drive mechanism having at least one motor, wherein on interruption of the energy supply the rotational speed of each of said drive mechanisms run down together with said rotational speed of the remaining ones of said drive mechanisms from a normal operational value of said rotational speed, the improvement wherein said drive mechanisms have a common synchronizing means, and are connected with each other operably by at least one torque transfer device independent of said synchronizing means.

2. The improvement according to claim 1 wherein at least one of said torque transfer devices has a means for limiting the torque transferred.

3. The improvement according to claim 2 wherein at least one of said torque transfer devices has a linkage means causing a frictional linkage between two of said drive mechanisms.

4. The improvement according to claim 1 wherein a switchable coupler is positioned in a working connection between at least one of said torque transfer devices and an associated one of said drive mechanisms.

5. The improvement according to claim 1 wherein at least one of said torque transfer devices has an overload safety means.

6. The improvement according to claim 1 wherein said common synchronizing means comprises a common rotational speed control for said motors of said drive mechanisms, said torque transfer device comprises a drive belt and two drive pulleys, each of which is attached to a different one of said drive mechanisms, and one of said drive pulleys has a shear pin attached thereto as an overload safety means.

7. The improvement according to claim 1 wherein said common synchronizing device comprises a common current supply device for said motors, when all of said motors are electric motors.

8. The improvement according to claim 1 wherein said torque transfer device comprises a first and second coupling means and a variable speed ratio gear unit, wherein said first coupling means is positioned between said variable speed ratio gear unit and said drive mechanism requiring a longer time for run down, and said second coupling means is positioned between said variable speed ratio gear unit and said drive mechanism requiring a shorter time for said run down.

9. The improvement according to claim 8 wherein said first coupling means positioned between said variable speed ratio gear unit and said drive mechanism requiring a longer time for said run down comprises a switchable coupling, which is activated during power failure, wherein said second coupling means positioned between said variable speed ratio gear unit and said drive mechanism requiring a shorter time for said run down comprises a freely running member preventing a transfer of torque from said drive mechanism to said variable speed ratio gear unit, while allowing said transfer of said torque in the opposite direction from said variable speed ratio gear unit to said drive mechanism.

10. A machine for spinning or twisting fiber, yarn, thread, or the like comprising at least two kinds of working units, at least one electric motor associated with each of the drive mechanisms of each of said working units, a common synchronizing mechanism comprising a variable frequency current supply device for each of said drive mechanisms, said common synchronizing mechanism acting to maintain a predetermined rotational speed ratio between at least one pair of said drive mechanisms, and at least one torque transfer device connecting said pair of said drive mechanisms.

11. A machine for spinning and twisting according to claim 10 wherein said torque transfer device comprises a drive belt and two drive pulleys, each of which is attached to a different one of said pair of said drive mechanisms.

12. A yarn spinning or twisting frame which comprises:

an array of spindles;

a first drive mechanism including a first asynchronous electric motor individual to and operatively connected with said spindles for rotating same;

means for acting upon yarn wound on bobbins on said spindles;

a second drive mechanism including a second asynchronous electric motor operatively connected to said means and individual thereto for driving said means;

a common source of electric current supplying said motors for operating same at speeds in a given relationship to one another; and a mechanical transmission coupling said motors with one another for torque transmission therebetween in the event of lag of one of said mechanisms relative to the other mechanism.

13. The yarn spinning or twisting frame defined in claim 12 wherein said means is a set of drafting rollers.

14. The yarn spinning or twisting frame defined in claim 13 wherein said source is a variable frequency source of electric current.

15. The yarn spinning or twisting frame defined in claim 14 wherein said mechanical transmission includes a belt and pulley arrangement between shafts of said motors.

16. The yarn spinning or twisting frame defined in claim 14 wherein said mechanical transmission includes a torque transmission train including an overrunning clutch, a variable ratio transmission and a switchable clutch between shafts of said motors.

* * * * *